US011946015B2

(12) United States Patent
Kaneko

(10) Patent No.: US 11,946,015 B2
(45) Date of Patent: Apr. 2, 2024

(54) WATER GLYCOL-BASED HYDRAULIC FLUID

(71) Applicant: SHELL OIL COMPANY, Houston, TX (US)

(72) Inventor: Hiroshi Kaneko, Tokyo (JP)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/910,879

(22) PCT Filed: Apr. 1, 2021

(86) PCT No.: PCT/EP2021/058650
§ 371 (c)(1),
(2) Date: Sep. 12, 2022

(87) PCT Pub. No.: WO2021/198435
PCT Pub. Date: Oct. 7, 2021

(65) Prior Publication Data

US 2023/0105327 A1 Apr. 6, 2023

(30) Foreign Application Priority Data

Apr. 3, 2020 (JP) ..... 2020-067577

(51) Int. Cl.
*C10M 173/02* (2006.01)
*C10N 30/06* (2006.01)

(52) U.S. Cl.
CPC ..... *C10M 173/02* (2013.01); *C10M 2201/02* (2013.01); *C10M 2201/062* (2013.01); *C10N 2030/06* (2013.01)

(58) Field of Classification Search
CPC ..... C10M 173/02; C10M 2201/02; C10M 2201/062; C10M 2207/0225; C10M 2207/122; C10M 2207/126; C10M 2207/127; C10M 2207/129; C10M 2207/22; C10N 2030/06; C10N 2040/08
See application file for complete search history.

(56) References Cited

U.S. PATENT DOCUMENTS 3,580,847 A * 5/1971 Boehmer ..... C10M 173/02 252/78.3
3,992,312 A * 11/1976 Genjida ..... C10M 173/02 252/77
9,695,380 B2 7/2017 Greaves
2009/0242858 A1 10/2009 Palmerio et al.

FOREIGN PATENT DOCUMENTS

| | | | |
|---|---|---|---|
| JP | H04106196 | A | 4/1992 |
| JP | H06279780 | A | 10/1994 |
| JP | H07233391 | A | 9/1995 |
| JP | H08143888 | A | 6/1996 |
| JP | 2646308 | B2 | 8/1997 |
| JP | H09208985 | A | 8/1997 |
| JP | 2001107075 | A | 4/2001 |
| JP | 3233490 | B2 | 11/2001 |
| JP | 2007246684 | A | 9/2007 |
| JP | 2011241270 | A | 12/2011 |
| JP | 2012224795 | A | 11/2012 |
| JP | 2014051650 | A | 3/2014 |
| JP | 2016050217 | A | 4/2016 |

OTHER PUBLICATIONS

International Search Report and Written Opinion received for PCT Patent Application No. PCT/EP2021/058650, dated Jun. 24, 2021, 9 pages.
Office Action Received for Chinese Application No. 202180026623.4, dated Feb. 7, 2023, 14 Pages (7 Pages of English Translation and 7 Pages of Official Copy).
Office Action Received for Japanese Application No. 2020-067577, dated Jan. 23, 2024, 07 Pages(03 Pages of English Translation and 04 Pages of Official Copy).

* cited by examiner

*Primary Examiner* — Cephia D Toomer
(74) *Attorney, Agent, or Firm* — SHELL USA, INC.

(57) ABSTRACT

The present invention provides a water-glycol hydraulic fluid comprising 0.3-0.6% by mass in total of fatty acid sodium salt and/or fatty acid, and 0.3-0.6% by mass of dimerized fatty acid. The water-glycol hydraulic fluid also comprises 20-60% by mass water, 20-60% by mass glycol, 0.01-0.06% by mass alkali hydroxide compound selected from potassium hydroxide and/or sodium hydroxide, and 1.0-5.0% by mass alkanolamine.

3 Claims, No Drawings

WATER GLYCOL-BASED HYDRAULIC FLUID

CROSS REFERENCE TO RELATED APPLICATIONS

This is a National stage application of International application No PCT/EP2021/058650, filed 1 Apr. 2021, which claims priority of JP application No. 2020-067577, filed 3 Apr. 2020 which is incorporated herein by reference in its entirety.

TECHNICAL FIELD OF THE INVENTION

The present invention relates to an improved water-glycol hydraulic fluid used as a fire-resistant hydraulic fluid.

BACKGROUND OF THE INVENTION

Hydraulic equipment is used widely in industry, where it contributes to improvements in productivity, and is also used widely by the general public. The hydraulic fluid is used as a medium for transmitting power in hydraulic equipment. Hydraulic fluids are widely used in hydraulic equipment, and hydraulic fluids containing a mineral oil-based base oil are commonly used.

However, hydraulic equipment used in mechanical equipment such as die casting machinery, forging presses, steel-making equipment used in the steel industry where fire resistance is required, and hydraulic equipment used in amusement park equipment and stage equipment in indoor facilities where fire safety is important, cannot use petroleum-based hydraulic oils, which lack heat resistance, so flame-retardant water-based hydraulic fluids are used.

When a water-based water-glycol hydraulic fluid is used as a water-based hydraulic fluid, good wear resistance and lubricity are required so that hydraulic operations can be performed smoothly and the service life of hydraulic equipment can be extended. Therefore, water-based hydraulic fluid compositions obtained by, for example, adding a polyoxyalkylene glycol diether compound having a specific structure, a polyoxyalkylene glycol monoether compound, a polyoxypropylene glycol monoether compound, and a fatty acid salt to water are used to improve performance in terms of lubricity and wear resistance (see JP3233490 B2).

Some water-glycol hydraulic fluids also include a small amount of a neutralization product of glycerol borate and base obtained by reacting glycerol with boric anhydride or boron trichloride, such as in JP2646308 B2. Other water-glycol hydraulic fluids contain a water-soluble polyether having a specific structure derived from a water-soluble polyoxyalkylene polyol and glycidyl ether, for example in JP H07-233391 A.

It is an object of the present invention to obtain a water-glycol hydraulic fluid having greatly improved wear resistance and good performance without impairing any other type of performance provided by water-glycol hydraulic fluid by including specific additives in the water-glycol hydraulic fluid.

SUMMARY OF THE INVENTION

The present invention provides a water-glycol hydraulic fluid containing 20-60% by mass water and 20-60% by mass glycol, with the remainder being, for example, a fatty acid-based lubricant, alkaline hydroxide compound, thickener, rust inhibitor, anticorrosive, and antifoaming agent to bring the total to 100% by mass. As a result of extensive research and development conducted to solve this problem, the present inventor and others discovered that use of a small amount of a sodium salt of a specific fatty acid could significantly improve the wear resistance of a water-glycol hydraulic fluid. The present invention is based on this discovery. Specifically, the present invention is a water-glycol hydraulic fluid containing a fatty acid having from 4 to 18 carbon atoms, a sodium salt of a fatty acid having 4 to 18 carbon atoms, and a dimerized fatty acid. This fatty acid or sodium salt of a fatty acid can be used alone or in combination for a total amount of 0.3 to 0.6% by mass, and the dimerized fatty acid can be used in an amount of 0.3 to 0.6% by mass.

DETAILED DESCRIPTION OF THE INVENTION

The present invention can readily obtain an easy-to-use water-glycol hydraulic fluid having greatly improved wear resistance while maintaining and not impairing any other type of performance provided by water-glycol hydraulic fluid by including small amounts of a specific fatty acid and/or sodium salt of a specific fatty acid and a dimerized fatty acid in the water-glycol hydraulic fluid.

These fatty acids are saturated fatty acids having four or more carbon atoms. Examples include butyric acid, valeric acid, caproic acid, enanthic acid, caprylic acid, pelargonic acid, capric acid, undecylic acid, lauric acid, tridecylic acid, myristic acid, pentadecylic acid, palmitic acid, margaric acid, stearic acid, nonadecylic acid, and arachidic acid. These fatty acids can also be unsaturated fatty acids such as oleic acid, linoleic acid, and linolenic acid.

Examples of fatty acid sodium salts include sodium butyrate, sodium valerate, sodium caproate, sodium enanthate, sodium caprilate, sodium pelargonate, sodium caprate, sodium undecylate, sodium laurate, sodium tridecylate, sodium myristate, sodium pentadecylate, sodium palmitate, sodium margarate, sodium stearate, sodium nonadesilate, sodium arachidate, sodium oleate, sodium linoleate, and sodium linolenate These fatty acids and sodium salts of fatty acid are used alone or in combination in a total amount of 0.3 to 0.6% by mass, preferably 0.35 to 0.50% by mass, based on the total mass of the composition. Note that potassium salts, which are the same type of alkali metal salt, are not preferred. Use of sodium salts is preferred to potassium salts in terms of thermal stability.

Dimerized fatty acids are liquid fatty acids containing a dibasic acid of a C36 dicarboxylic acid produced by dimerization of a C18 unsaturated fatty acid containing a vegetable fat or oil as a main component, but also a monobasic acid and a tribasic acid. These dimerized fatty acids are included in an amount of 0.3 to 0.6% by mass, preferably 0.35 to 0.50% by mass, based on the total mass of the composition.

A water-glycol-based hydraulic fluid of the present invention contains 20-60% by mass glycol, 0.01-0.06% by mass alkali hydroxide compound selected from potassium hydroxide and/or sodium hydroxide, and 1.0-5.0% by mass of alkanolamine. It also contains a fatty acid sodium salt or fatty acid having from 4 to 12 carbon atoms and a dimerized fatty acid. The water-glycol-based hydraulic solution contains water. The amount of water is 20-60% by mass, more preferably 30-50% by mass, and the amount of water added brings the total amount of hydraulic fluid composition to 100% by mass.

Examples of glycols include ethylene glycol, propylene glycol, butylene glycol, hexylene glycol, diethylene glycol, dipropylene glycol, dibutylene glycol, dihexylene glycol, trimethylene glycol, triethylene glycol, and tripropylene glycol. These glycols can be used alone or in mixtures of two or more. Use of propylene glycol or dipropylene glycol is preferred. The amount of glycol used is 20-60% by mass, and more preferably 30-50% by mass, relative to the total mass of the water-glycol hydraulic fluid composition.

Examples of alkali hydroxide compounds include potassium hydroxide and sodium hydroxide. These may be used alone or together when appropriate. The amount of alkaline hydroxide compound is 0.01-0.12% by mass, and more preferably 0.04-0.06% by mass, relative to the total mass of the composition.

An alkanolamine can be used as a rust inhibitor. Examples of alkanolamines include methanolamine, ethanolamine, propanolamine, diethanolamine, triethanolamine, dimethylethanolamine, N-methylethanolamine, N-methyldiethanolamine, N,N-dimethylaminoethanol, N,N-diethylaminoethanol, N,N-dipropylaminoethanol, N,N-dibutylaminoethanol, N,N-dipentylaminoethanol, N,N-dihexylaminoethanol, N,N-diheptylaminoethanol, and N,N-dioctylaminoethanol. The alkanolamine is included in an amount of 1.0 to 5.0% by mass based on the total mass of the composition.

A specific phosphoric acid ester compound can be used as an antiwear agent. This phosphoric acid ester has the following structure.

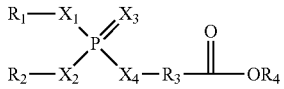

(1)

In this formula, $R_1$ and $R_2$ may be the same or different and represent a hydrogen atom or a hydrocarbon group having from 1 to 30 carbon atoms, $R_3$ represents a hydrocarbon group having from 1 to 20 carbon atoms, $R_4$ represents a hydrogen atom or a hydrocarbon group having from 1 to 30 carbon atoms, and $X_1$, $X_2$, $X_3$ and $X_4$ may be the same or different and represent an oxygen atom or a sulfur atom.

If necessary, commonly used additives may be included in the water-glycol hydraulic fluid. Examples include thickeners, lubricants, metal deactivators, wear inhibitors, extreme pressure agents, dispersants, metal detergents, friction modifiers, corrosion inhibitors, anti-emulsifiers, and defoamers. These additives may be used alone or in combination with each other. Here, an additive package for water-glycol hydraulic fluids may be used.

Examples

Water-glycol hydraulic fluids of the present invention will now be described in detail with reference to examples and comparative examples. The present invention is not limited to these examples.

Example 1

A water-glycol hydraulic fluid was obtained by thoroughly mixing together 0.450% by mass sodium laurate as the sodium salt of fatty acid, 0.400% by mass dimerized fatty acid, 38.628% by mass propylene glycol as the glycol, 0.06% by mass of sodium hydroxide as the alkali hydroxide compound, 1.90% by mass of N, N-dibutylaminoethanol as the alkanolamine, 16.10% by mass water-soluble polymer as the thickener, a total of 0.620% by mass of other additives including a corrosion inhibitor and an antifoaming agent, and 41.842% by mass water. The alkali reserve obtained in accordance with JIS K2234-1994 was 20. The 40° C. kinematic viscosity was 46 $mm^2/s$ and the pH was 11.

Example 2

A water-glycol hydraulic fluid was obtained by thoroughly mixing together 0.200% by mass sodium laurate, 0.225% by mass lauric acid, 0.400% by mass dimerized fatty acid, 38.653% by mass glycol, 0.06% by mass sodium hydroxide, 1.90% by mass N, N-dibutylaminoethanol, 16.10% by mass water-soluble polymer as a thickener, 0.620% by mass of other additives, and 41.842% by mass water. The alkali reserve obtained in accordance with JIS K2234-1994 was 20. The 40° C. kinematic viscosity was 46 $mm^2/s$ and the pH was 11.

Example 3

A water-glycol hydraulic fluid was obtained by thoroughly mixing together 0.400% by mass of lauric acid as the fatty acid, 0.400% by mass dimerized fatty acid, 38.678% by mass glycol, 0.06% by mass sodium hydroxide, 1.90% by mass N, N-dibutylaminoethanol, 16.10% by mass water-soluble polymer as a thickener, 0.620% by mass other additives, and 41.842% by mass water. The alkali reserve obtained in accordance with JIS K2234-1994 was 20. The 40° C. kinematic viscosity was 46 $mm^2/s$ and the pH was 11.

Comparative Examples 1-3

The water-glycol hydraulic fluids in Comparative Examples 1-3 were obtained in the same manner as Example 1 using the compositions shown in Table 2.

Tests

The following tests were performed to evaluate the lubricity performance of the hydraulic fluids in the examples and comparative examples.

Shell Four Ball Lubricant Test

The operations were performed at room temperature for 30 minutes in accordance with ASTM D4172, in which the spindle rotation speed was 1500 rpm and the load was 40 kgf. Afterward, the diameter (mm) of the wear marks on the steel balls was measured.

Evaluation Standards:

Wear mark diameter≤0.65 mm . . . . . Passed (○)

Wear mark diameter>0.65 mm . . . . . Failed (×)

Lubricity Pump Test

A hydraulic pump (PV2R1-25 from Yuken Kogyo) was operated under the following conditions using the hydraulic fluids in the examples in order to evaluate their lubricity.

Pressure setting: 21 Mpa

Temperature setting: 45° C.

Testing time: 250 hrs

Oil volume: 40 liters

Superiority and inferiority were judged based on the total amount of wear (mg) on the vanes and the cam ring after 250 hours of operation. A lower total amount of wear is an indicator of superior lubricity.

Evaluation Standards:

Total amount of wear on vanes and cam ring≤60 mg . . . . . Passed

The test results are shown in Table 1 and Table 2.

TABLE 1

| | Ex. 1 | Ex. 2 | Ex. 3 |
|---|---|---|---|
| Sodium laurate | 0.450 | 0.200 | |
| Lauric acid | | 0.225 | 0.400 |
| Dimerized fatty acid | 0.400 | 0.400 | 0.400 |
| Alkanolamine | 1.900 | 1.900 | 1.900 |
| Glycol | 38.628 | 38.653 | 38.678 |
| Alkali hydroxide compound | 0.060 | 0.060 | 0.060 |
| Thickener | 16.100 | 16.100 | 16.100 |
| Other additives | 0.620 | 0.620 | 0.620 |
| Water | 41.842 | 41.842 | 41.842 |
| Total | 100.000 | 100.000 | 100.000 |
| Wear mark diameter (mm) | 0.46 | 0.49 | 0.52 |
| | ○ | ○ | ○ |
| Total amount of wear (mg) | 45.3 | — | 59.2 |

TABLE 2

| | Comp. Ex. 1 | Comp. Ex. 2 | Comp. Ex. 3 |
|---|---|---|---|
| Lauric acid | 0.200 | | 0.400 |
| Dimerized fatty acid | 0.200 | 0.400 | |
| Alkanolamine | 1.900 | 1.900 | 1.900 |
| Glycol | 39.078 | 39.078 | 39.078 |
| Alkali hydroxide compound | 0.060 | 0.060 | 0.060 |
| Thickener | 16.100 | 16.100 | 16.100 |
| Other additives | 0.620 | 0.620 | 0.620 |
| Water | 41.842 | 41.842 | 41.842 |
| Total | 100.000 | 100.000 | 100.000 |
| Wear mark diameter (mm) | 0.78 | 0.87 | 0.88 |
| | x | x | x |

As shown in Table 1, in Example 1, which contained a fatty acid sodium salt, the wear mark diameter in the Shell four ball lubricant test was a low 0.46 mm, and the total amount of wear after 250 hours in the lubricity pump test was 45.3 mg. These results indicate superior lubricity performance. In Example 2, which contained less fatty acid sodium salt and the same fatty acid, the wear mark diameter in the Shell four ball lubricant test was 0.49 mm, which is a good result. In Example 3, which contained only a fatty acid, the wear mark diameter in the Shell four ball lubricant test was a low 0.52 mm, and the total amount of wear in the lubricity pump test was 59.2 mg. These results indicate superior lubricity performance.

As shown in Table 2, Comparative Example 1, which did not contain a fatty acid sodium salt and which included less fatty acid and dimerized fatty acid, failed in terms of the wear mark diameter. Comparative Example 2, which contained neither a fatty acid nor a fatty acid sodium salt, also failed. Comparative Example 3, which did not contain a dimerized fatty acid, failed as well. Because Comparative Examples 1-3 all failed in terms of the wear mark diameter, measurement of the total amount of wear in the lubricity pump test was omitted.

We claim:

1. A water-glycol hydraulic fluid comprising 20-60% by mass water, 20-60% by mass glycol, 0.01-0.06% by mass alkali hydroxide compound selected from potassium hydroxide and/or sodium hydroxide, 1.0-5.0% by mass alkanolamine, 0.3-0.6% by mass in total of fatty acid sodium salt and/or fatty acid having from 4 to 18 carbon atoms, and 0.3-0.6% by mass of dimerized fatty acid.

2. The water-glycol hydraulic fluid according to claim 1, wherein the fatty acid sodium salt is sodium laurate having 12 carbon atoms.

3. The water-glycol hydraulic fluid according to claim 1, wherein the fatty acid is lauric acid having 12 carbon atoms.

* * * * *